US007462992B2

(12) United States Patent
Arbinger et al.

(10) Patent No.: US 7,462,992 B2
(45) Date of Patent: Dec. 9, 2008

(54) STARTER CIRCUIT HAVING REGULATED STARTER VOLTAGE

(75) Inventors: Kai Arbinger, Hard (AT); Roman Ploner, Hohenems (AT); Hendrik Hein, Vienna (AT)

(73) Assignee: TridonicAtco GmbH & Co. KG, Dornbirn (AT)

( * ) Notice: Subject to any disclaimer, the term of this patent is extended or adjusted under 35 U.S.C. 154(b) by 1 day.

(21) Appl. No.: 10/555,086

(22) PCT Filed: Apr. 16, 2004

(86) PCT No.: PCT/EP2004/004064

§ 371 (c)(1),
(2), (4) Date: Dec. 22, 2006

(87) PCT Pub. No.: WO2004/098244

PCT Pub. Date: Nov. 11, 2004

(65) Prior Publication Data

US 2007/0080650 A1 Apr. 12, 2007

(30) Foreign Application Priority Data

Apr. 30, 2003 (DE) ..... 103 19 511

(51) Int. Cl.
*H05B 37/00* (2006.01)

(52) U.S. Cl. ..... 315/289; 315/290; 315/291; 315/276; 315/307; 315/360; 315/DIG. 5

(58) Field of Classification Search ..... 315/289, 315/290, 276, 283, 291, 200 R, 223, 239, 315/240, 245, 209 CD, 209 T, DIG. 5, 307, 315/360, 362
See application file for complete search history.

(56) References Cited

U.S. PATENT DOCUMENTS

| | | | | |
|---|---|---|---|---|
| 4,337,417 A | | 6/1982 | Johnson | 315/290 |
| 4,403,173 A | * | 9/1983 | Mayer | 315/289 |
| 4,461,982 A | * | 7/1984 | Fahnrich | 315/290 |
| 4,937,501 A | * | 6/1990 | Ganser et al. | 315/209 R |

(Continued)

FOREIGN PATENT DOCUMENTS

DE 44 21 736 C2 1/1996

(Continued)

*Primary Examiner*—Haissa Philogene
(74) *Attorney, Agent, or Firm*—Fitzpatrick, Cella, Harper & Scinto

(57) ABSTRACT

A circuit for the generation of ignition pulses for a lamp has: an ignition pulse transformer, a device for the generation of ignition pulses (ignition pulse generator) at a primary winding of the ignition pulse transformer, which are transformed in the secondary winding of the ignition pulse transformer, a voltage detector for the detection of the voltage value of the transformed ignition pulses, and a voltage regulator for regulating the voltage value of the transformed ignition pulses to a predetermined reference value. The ignition pulse generator has, in a series circuit, a pulse capacitor and a switch, parallel to the secondary winding of the ignition pulse transformer and the lamp, wherein the regulator for the voltage value of the transformed ignition pulses sets at the pulse capacitor the voltage applied at an ignition time point. The voltage at the pulse capacitor can be set by means of selection of the switch-on and/or switch-off time points of the switch.

18 Claims, 6 Drawing Sheets

U.S. PATENT DOCUMENTS

| | | | | | |
|---|---|---|---|---|---|
| 5,166,581 | A | * | 11/1992 | Chermin et al. | 315/289 |
| 5,424,617 | A | * | 6/1995 | Garbowicz et al. | 315/289 |
| 5,811,940 | A | | 9/1998 | Nutzel | 315/291 |
| 6,057,650 | A | | 5/2000 | Betz et al. | 315/289 |
| 6,127,782 | A | * | 10/2000 | Flory et al. | 315/129 |
| 6,362,576 | B1 | | 3/2002 | Huber et al. | 315/289 |
| 6,452,340 | B1 | | 9/2002 | Morrissey, Jr. et al. | 315/151 |

FOREIGN PATENT DOCUMENTS

| | | | |
|---|---|---|---|
| EP | 1 043 917 | A2 | 10/2000 |
| EP | 1 196 012 | A2 | 4/2002 |
| GB | 2 308 930 | A | 7/1997 |

* cited by examiner

L
ZW
VG
HW
LA
P
LA
R1
L1
C1
Compensation
Lamp
4M53
S1
U1
Control
Uz-Ref
Ignition
Apparatus
N (L2)
ZG
N (L2)

STARTER CIRCUIT HAVING REGULATED STARTER VOLTAGE

This application is a national stage application pursuant to 35 U.S.C. § 371 of international application no. PCT/EP2004/004464, which is incorporated herein by reference in its entirety.

BACKGROUND OF THE INVENTION

1. Field of the Invention

The present invention relates to circuits for the generation of ignition pulses for a lamp, such as for example a high-pressure gas discharge lamp, and to methods for the generation of ignition pulses for a lamp. Finally, the invention also relates to lamp ballasts, which have such ignition circuits.

2. Description of the Related Art

Generally it is the task of ignition circuits of the kind concerned to send so-called ignition voltage pulses to the lamp, which ensure a reliable lamp ignition during a certain phase condition of the mains voltage.

From WO 97/08921, the ignition circuit illustrated in FIG. 6 is known. The ignition circuit schematically shown in FIG. 6 has a choke 3, serving as a magnetic ballast, a pulse transformer 5, the secondary winding 6 of which is connected in series with the choke 3 and the high-pressure gas discharge lamp 4, and the primary winding 8 of which is connected in series with a switch element 9, and a pulse capacitor 7, wherein the pulse capacitor 7 on the one hand and the series circuit of the primary winding 8 and the switching element 9 on the other hand form a parallel circuit, which for its part is connected in series with a load resistance 13 to a controllable switch 10. The controllable switch 10 is for example a bipolar transistor or field effect transistor controlled in a rectifier bridge.

Further, there is present an auxiliary ignition capacitor 11 and a control circuit 12, which serves for control of the controllable switch 10. The control circuit 12 controls the controllable switch 10 temporally in dependence upon the appearance of an ignition pulse for the high-pressure discharge lamp 4, an ignition pulse being detected by means of an ignition pulse detector 15 which is connected with the pulse transformer 5 by means of a specific winding 14.

The functioning of the circuit shown in FIG. 6 is thereby as follows:

Initially, the controllable switch 10 is open, so that the parallel circuit formed of a pulse capacitor 7, the primary winding 8 of the pulse transformer 5 and the sidac 9 is separated from the a.c. voltage supply applied at the terminals 1. The control circuit, for example an ASIC, contains preferably a counter which is set in operation when a zero crossing of the mains voltage occurs or the mains voltage has reached a certain level, which corresponds to a certain switching angle. By counting down it can be determined when the required switching angle, i.e. the phase disposition required by the lamp manufacturers, between 60° EL to 90° EL or 240° EL to 270° EL, is attained. When the desired phase disposition is attained, the controllable switch 10 is closed, whereby the voltage applied at the auxiliary ignition capacitor 11 is reduced for a short time, since through the closing of the controllable switch 10 the pulse capacitor 7 is connected in parallel with the auxiliary ignition capacitor 11. The secondary winding 6 of the pulse transformer 5 is itself of low resistance.

After the closing of the controllable switch 10, normal ignition behavior arises, i.e. the voltage applied at the pulse capacitor 7 increases through the charging of the pulse capacitor 7 via the load resistance 13, so that the voltage applied to the lamp 4 or the auxiliary ignition capacitor 11 also increases. When the switching voltage of the sidac 9 is attained, this short-circuits and the pulse capacitor is discharged via the primary winding 8 of the pulse transformer 5 and the sidac 9, through which an ignition pulse is generated at the high-pressure discharge lamp 4, which is reported to the control circuit 12 via the coupled winding 14 and the ignition pulse detector 15.

With detection of an ignition pulse, the control circuit 12 immediately opens the controllable switch 10, so that the oscillation circuit formed of the pulse capacitor 7, the sidac 9 and the primary winding 18 of the pulse transformer 5 very quickly decays, since no new energy is delivered to this oscillation circuit. Through this, the holding current of the sidac 9 is very quickly undershot, which allows the switch 10 to be again closed, shortly after the opening of the switch 10, so that a rapid ignition pulse sequence can be attained.

A disadvantage of this circuit is that it does not take into account that the ignition voltage sinks with the line capacitance.

From EP 479351 A1 there is known a self-adapting ignition circuit, which attempts to provide assistance with regard to this problem.

In accordance with this publication, there are provided two pulse capacitors which can be switched parallel to one another. If a circuit (IV in FIG. 1) now detects that the ignition pulse applied at the lamp itself does not have sufficient amplitude, the second pulse capacitor is switched in parallel with the actual first pulse capacitor by means of actuation of a switch, which as is known increases the capacitance, through which in a following ignition process the ignition pulse amplitude is correspondingly increased.

The procedure in accordance with EP 479 351 A1 is thus such that one begins always with an ignition procedure with the employment of a single pulse capacitor, and for the event that the amplitude of the ignition pulse at the lamp is not sufficient, a second capacitor is switched in parallel. There is thus provided a discrete increase of the capacitance and thus of the ignition pulse amplitude. A reduction of the capacitance is, in contrast, not provided for.

SUMMARY OF THE INVENTION

Even though, in accordance with EP 479 351 A1, thus an attempt is undertaken to ensure a sufficient ignition pulse amplitude in the lamp, this still does not make possible an efficient compensation of the permissible tolerances of the overall ignition system with regard to

- mains voltage range,
- line capacitance,
- environmental temperature,
- use of ballasts (of different manufacturers) having different tappings and different construction (at present, for each pulse ignition apparatus an exactly matched ballast must be built), and
- the difference between grounded and non-grounded ballasts.

The object of the present invention is correspondingly to indicate a technology for an improved ignition system, which ensures a sufficient ignition pulse amplitude at the lamp in an efficient manner.

More precisely stated, the present invention is aimed towards a technology for the (continuous) regulation of the ignition pulse amplitude such that due to the regulation of the ignition pulse amplitude the desired value for the ignition voltage can be placed close to the lower limit of the performance window required by the lamp manufacturer, through which the loading of the ballast and the other components can be reduced and thus their operating lifetime significantly increased.

More precisely stated, the above indicated object is achieved by means of the features of the independent claims. The dependent claims further develop the central concept of the present invention in particular advantageous manner.

In accordance with a further aspect of the invention there is provided a circuit for the generation of ignition pulses for a lamp, wherein the circuit has an ignition pulse transformer (which can also serve, after the ignition, if appropriate, as choke for the lamp current). Further there is provided a device for the generation of ignition pulses at a primary winding (ignition winding) of the ignition pulse transformer, wherein the ignition pulses are transformed in the secondary winding (main winding) of the ignition pulse transformer. Further there are provided means for the detection of the voltage value (amplitude at the terminal LA of the ignition apparatus) of the transformed ignition pulses and a device for the regulation of the voltage value of the transformed ignition pulses to a predetermined reference value.

By the expression "regulation of the voltage value of the transformed ignition pulses", there is thus to be understood that the said device is adapted, corresponding to a difference, if arising, from a predetermined reference value not only to increase but also, if appropriate, to decrease the actual amplitude of the applied ignition pulses—depending upon the sign of the difference.

In particular thereby, the voltage value of the transformed ignition pulses may be continuously regulatable. This permits a more efficient and more fine control of the ignition voltage applied at the lamp, in particular in comparison with EP 0 479 351 A1 mentioned above.

The device for the generation of ignition pulses may have a series circuit of a pulse capacitor and a switch parallel to the secondary winding of the ignition pulse transformer and the lamp. The device for regulation of the voltage value of the transformed ignition pulses can thereby set the pulse voltage at the pulse capacitor applied at the ignition time point as control value.

This can be effected for example by means of selection of the switch-on and/or switch-off points of the switch. To this extent, also other possibilities are conceivable as to how the pulse voltage at the pulse capacitor applied at the ignition time point can be set (settable voltage sources etc.). Whereas thus with the state of the art (see EP 479 351 A1) the capacitance of the ignition circuit is increased in a discrete manner by switching in of a further pulse capacitor, the present invention proposes in advantageous manner not to change the capacitance and in its place to change the pulse voltage, which has the advantage that this can be effected continuously in more simple manner and beyond this makes the provision of a plurality of pulse capacitors superfluous.

The device for the regulation of the voltage value of the transformed ignition pulses may for example control the switch-on duration of the switch.

Fundamentally, the switch can be opened and closed at arbitrary time points, in particular however closed at a time point (if appropriate a fixed time point) before the peak of a mains half-wave and preferably opened once before attainment of the peak of the directly following mains half-wave and again newly closed.

In accordance with a further aspect of the present invention there is provided a circuit for the generation of ignition impulses for a lamp, which has:

an ignition pulse transformer, a device for the generation of ignition pulses at a primary winding of the ignition pulse transformer, which are transformed in the secondary winding of the ignition pulse transformer, wherein the device has a series circuit of a pulse capacitor and a switch parallel to the secondary winding of the ignition pulse transformer and the lamp, wherein with opened switch the charge in the pulse capacitor is in substance retained and with closed switch the pulse capacitor charges up to the current instantaneous value of the mains voltage. Finally, a further control unit is provided by means of which the switch-on/switch-off time points of the switch can be set as desired.

The control unit can control the switch-on time duration of the switch, whereby the switch-on time point, if appropriate, is selected fixedly synchronously to a predetermined phase disposition of the mains voltage.

For current limiting, an Ohmic resistance and/or an inductance may be connected in series with the switch.

In accordance with a further aspect of the present invention there is provided a method for the generation of ignition pulses for a lamp, wherein ignition pulses are generated in a primary winding of an ignition pulse transformer and transformed in the secondary winding of the ignition pulse transformer. The voltage value (amplitude) of the transformed ignition pulses is detected. The voltage value of the transformed ignition pulses is then regulated to a predetermined reference value, in dependence upon the detected voltage value of the transformed ignition pulses. Here also it is to be understood that regulation includes the possibility of both increasing and also decreasing the amplitude of the transformed ignition pulses.

The voltage value of the transformed ignition pulses can be regulated by means temporal control of the charge/discharge processes of a pulse capacitor.

The method may have the step that a switch for the charging/discharging of the pulse capacitor is closed to the time point before the peak of a mains half-wave and before attainment of the peak of the directly following mains half-wave is opened and again closed.

Further features, advantages and characteristics of the present invention will now be explained in more detail with reference to the accompanying Figures of the drawings and with reference to an exemplary embodiment.

DETAILED DESCRIPTION OF THE INVENTION

Figure 1:
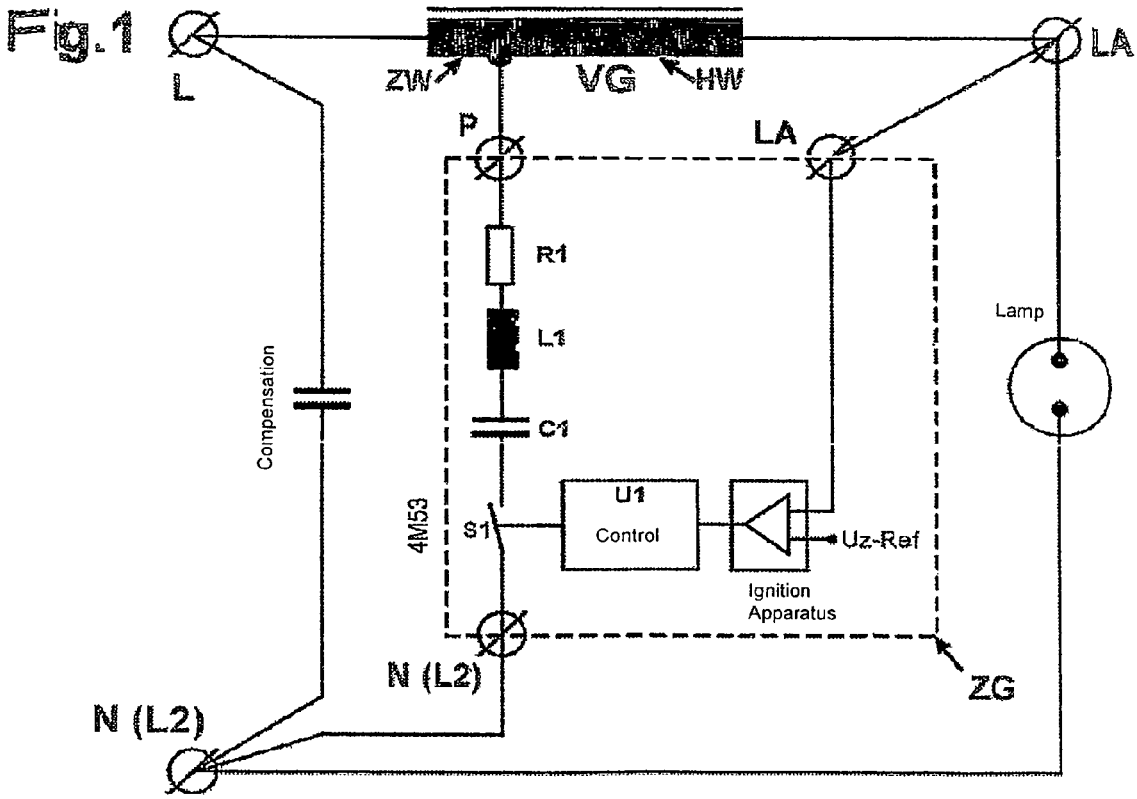
FIG. 1 a schematic illustration of an ignition circuit in accordance with the invention, FIGS. 2 and 3 diagrams which illustrate the regulation of the ignition pulse amplitude by means of selection of the switch-on duration of a switch of the ignition circuit, FIG. 4 a more detailed view of the ignition circuit in FIG. 1, FIG. 5 a detailed view of the control unit of an ignition circuit in accordance with the invention, and FIG. 6 a circuit known from WO 97/08921.

In FIG. 1 there is schematically shown a ballast for example for a high-pressure gas discharge lamp. The mains voltage is thereby applied to the terminals L, N (L2), whereby between these mains voltage terminals L, N an optional compensation capacitor may be connected (central compensation in the ballast can also be provided). Further, there can be seen a pulse transformer VG of the ballast having an ignition winding ZW and a main winding HW connected in series thereto, whereby the pulse transformer VG, after the ignition of the schematically illustrated lamp, serves as choke for the lamp current. Between the ignition winding ZW of the pulse transformer VG and a terminal for the mains voltage N(L2) there is provided an ignition apparatus (ignition circuit) generally designated by ZG.

The ignition pulse transformer VG thus serves, after lamp start has been effected, as a current limiting choke. The ignition winding ZW and the main winding HW thereby serve, as soon as the lamp is ignited, in per se known manner for current limiting for the lamp.

The ignition apparatus ZG has on the one hand a series circuit (series oscillation circuit) of a current limiting resistance R1, an inductance L1 and a pulse capacitor C1. Further, the ignition apparatus ZG has a switch S1 (for example a bipolar transistor and MOSFET transistor), through the control of which the charging/discharging processes of the pulse capacitor C1 can be controlled.

The switch S1 is thereby actuated by means of a control unit, which controls the switch-on/switch-off processes of the switch in dependence upon a difference, detected by a comparator, between a reference voltage $U_{Z\text{-}REF}$ and a detected actual amplitude of the ignition pulse at the lamp LA.

In known manner, for ignition, the switch S1 (preferably a semiconductor in a diode rectifier bridge) is closed, so that an ignition pulse current flows via the series circuit consisting of the ignition winding ZW, the pulse capacitor C1, inductance L1 and the current limiting resistance R1. This pulse current is transformed in the main winding HW of the ignition pulse transformer VG to an ignition voltage pulse, with which the high-pressure gas discharge lamp can be ignited.

With regard to FIG. 1 it is also to be noted that on the one hand the control of the switch S1 is carried out in dependence upon a detected difference between a desired value $U_{Z\text{-}REF}$ and the actual amplitude of the ignition pulse at the lamp. On the other hand, this control can naturally be continuously changed, i.e. in contrast to the state of the art the switch S1 can be so controlled that during a mains half-wave it can be switched-on and switched-off as desired. The switching on thereby represents, as is known, the ignition time point.

In the following, it will be illustrated with reference to FIG. 2 and FIG. 3 how, through the switch-on and switch-off behavior of the switch S1 the voltage in the pulse capacitor C1 and correspondingly also the ignition voltage at the terminal LA can in substance be changed arbitrary and continuously. This arbitrary setting of the ignition pulse voltages at the terminal LA makes possible the efficient compensation of the tolerances of the ignition system already mentioned above (mains voltage, line capacitance, environmental temperature range, grounded or non-grounded ballast, etc.). This in turn allows the desired value for the ignition pulse amplitude $U_{Z\text{-}REF}$ to lay slightly above the lower limit of the performance window required by the lamp manufacturer, through which the load of the ballast is reduced and thus the working life can be significantly increased.

Figure 2:
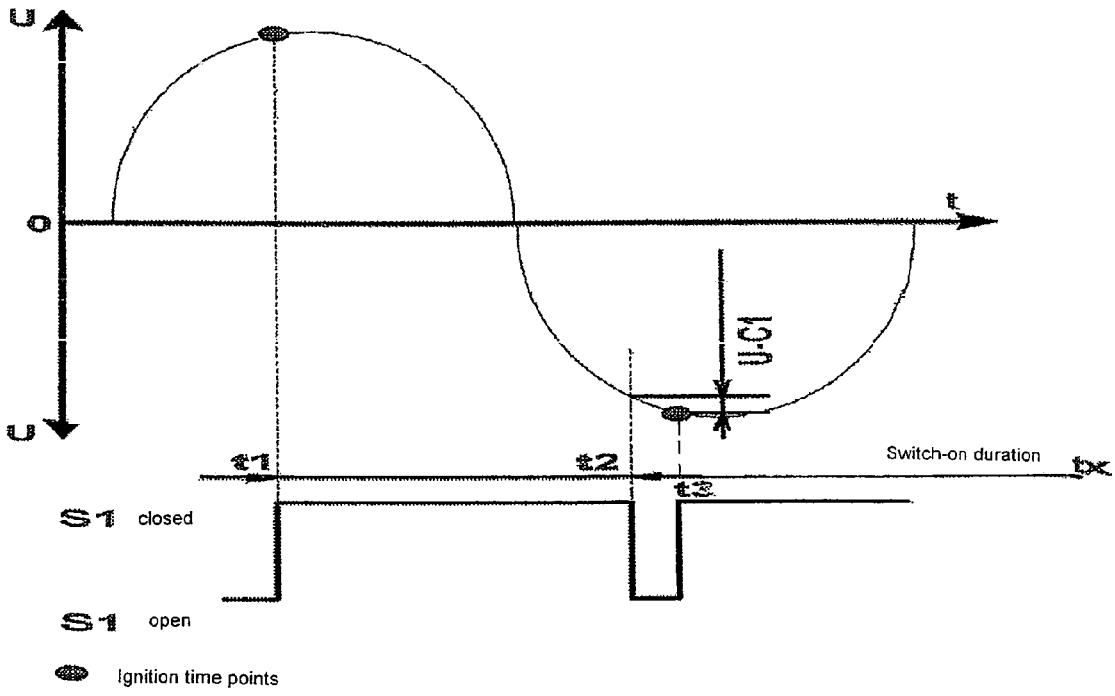

In FIG. 2 the case is shown that as usual shortly before the attainment of the peak of a mains half-wave (time point $t_1$) the switch S1 is closed, through which at least one ignition pulse is triggered at this defined phase disposition of the mains voltage. The series circuit (series oscillation circuit) of the ignition circuit reacts to this closing of the switch S1 with a pulse current, in order compensate the charge difference at the pulse capacitor C1. Whilst the switch S1 remains closed, the series oscillation circuit R1, L1, C1 oscillates out and the voltage at the pulse capacitor adapts continuously to the actual value of the applied mains voltage.

In the scenario of FIG. 2, the switch S1 then remains closed relatively long, up to a time point $t_2$. The voltage applied at the pulse capacitor C follows during this entire switch-on time tx in substance of the actual value of the applied mains voltage. At the time point $t_2$ the switch S1 is again opened so that at the pulse capacitor C1 in substance a voltage is applied, and during the opening time of the switch S1 is maintained, which corresponds to the value of the mains voltage at the time point $t_2$.

Since the switch-off time point $t_2$ lays only very shortly before the next following switch-on time point (ignition time point) $t_3$, the difference between the voltage at the pulse capacitor C1 and the value of the main voltage at the ignition time point $t_3$ is relatively slight, which thus would produce a relatively slight pulse voltage at the pulse capacitor C1 and correspondingly a slight ignition pulse amplitude at the terminal LA. Thus, the closer the switch-off time point $t_2$ is moved towards the next following ignition time point $t_3$ (in other words, the longer, with a fixed ignition time point, the switch-on time duration tx of the switch S1 is), the lesser will be the ignition pulse amplitude yielded at the terminal LA. The ignition pulse amplitude can thus, if appropriate, be set as far as zero, if $t_2$ corresponds in substance to the switch-on and ignition time point $t_3$ or the switch S1 remains constantly switched on.

Figure 3:
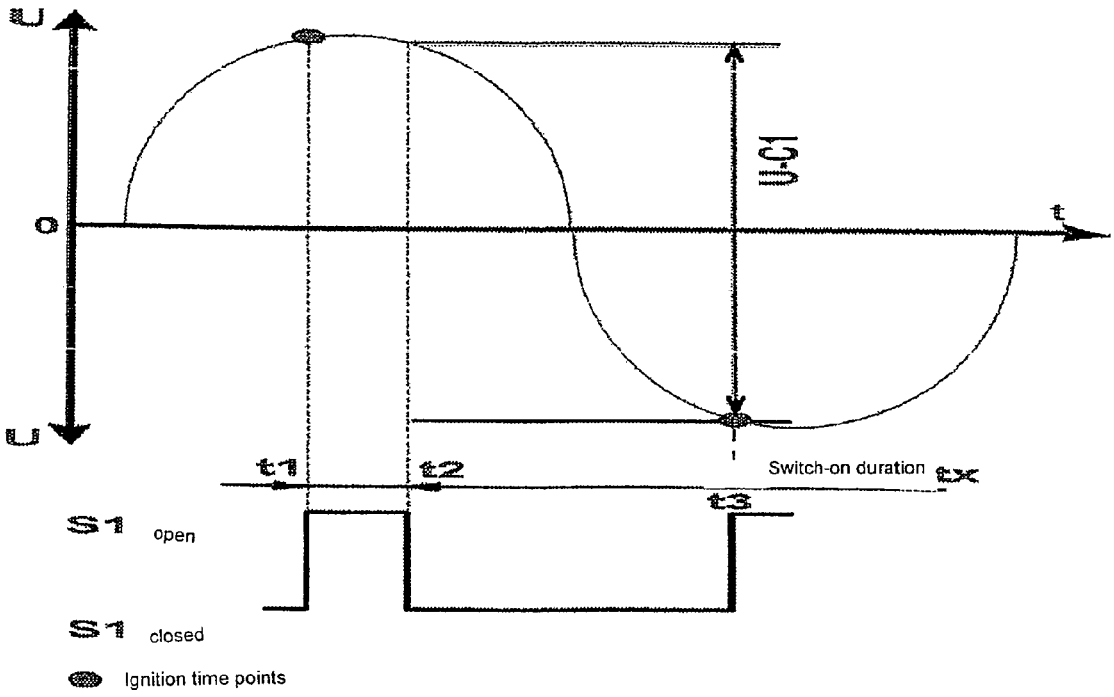

FIG. 3 shows on the other hand the scenario that the switch S1, after a switch-on and ignition time point $t_1$, after a relatively short switch-on duration tx, is already again opened at a time point $t_2$ and thus at the pulse capacitor C1 this relatively high value of the mains voltage at this time point $t_2$ is retained. When now with a following ignition (corresponding to switching on of the switch S1) at a time point $t_3$ one or more ignition pulses are generated, these have a large amplitude (in comparison to the scenario of FIG. 2) since the pulse voltage, i.e. the difference between the voltage retained at the pulse capacitor C1 (in substance equal to the value of the mains voltage at the time point $t_2$) and the value of the mains voltage present at the ignition time point $t_3$, is very great.

In the extreme case, i.e. when the switching-off of the switch S1 is effected in the region of the peak of a first mains half-wave and the ignition, on the other hand, is effected in the range of the peak of the following mains half-wave, the pulse voltage at the capacitor C1 assumes a maximum value, i.e. about double the peak value of the mains voltage. By reduction of the switch-on duration of the switch S1, the amplitude of the ignition pulse voltage at the terminal LA can thus be continuously increased.

In any event, in accordance with the invention the pulse voltage can, through corresponding charge transfer of the pulse capacitor, exceed the peak value of the mains voltage (voltage overshoot).

The invention thus takes the path that the voltage at the pulse capacitor is settable, in order thus in the end to set the ignition pulse amplitude. The capacitance in the ignition apparatus ZG need not, in contrast, be changed. The pulse voltage is thereby, in accordance with the exemplary embodiment, determined by the selection of the switch-on and switch-off time points of the switch within a mains half-wave.

Usually, the ignition time point and thus the switch-on time point $t_1$, $t_3$ is predetermined in accordance with the requirements of the lamp manufacturer. In contrast, in accordance with the invention, the switch-off time point $t_2$, $t_2'$, and thus the switch-on duration tx, can be arbitrarily altered.

Figure 4:
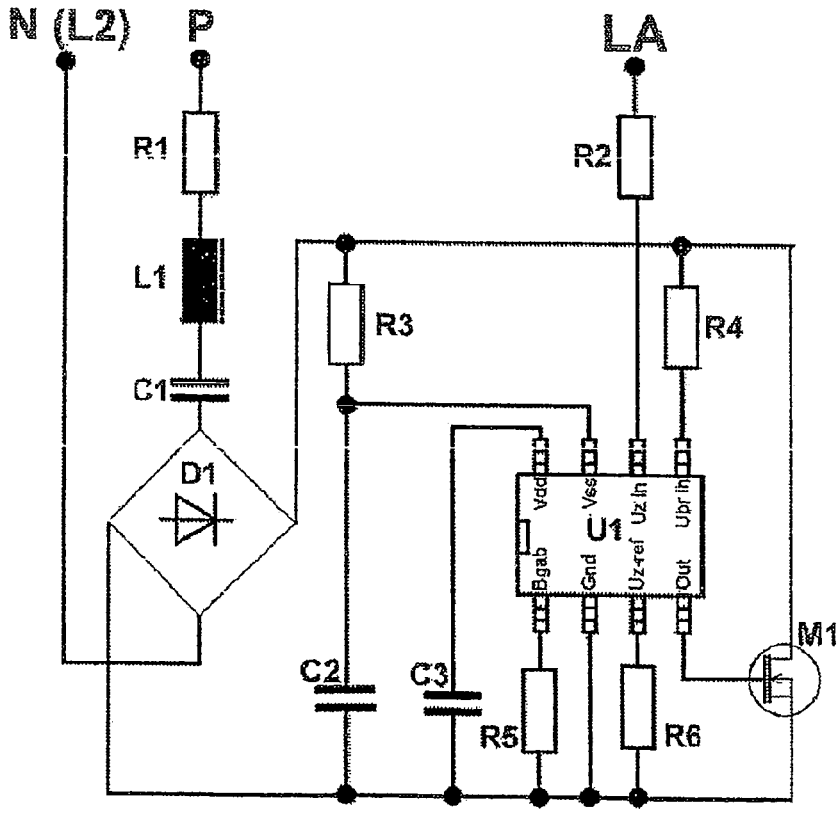
Figure 5:
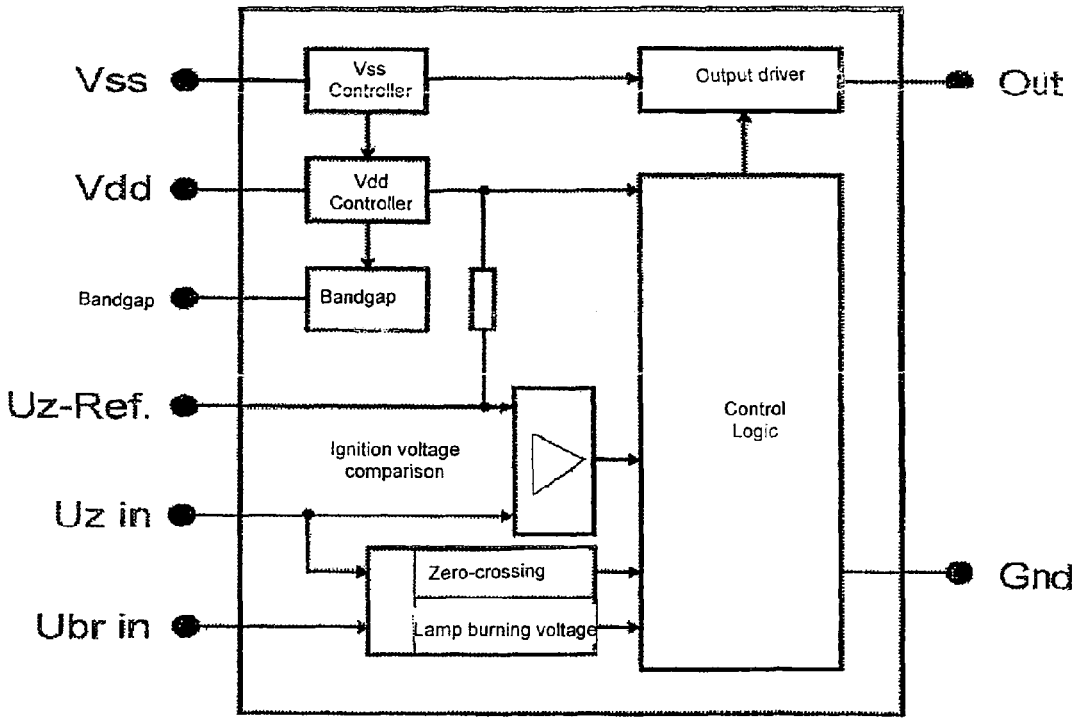
Figure 6:
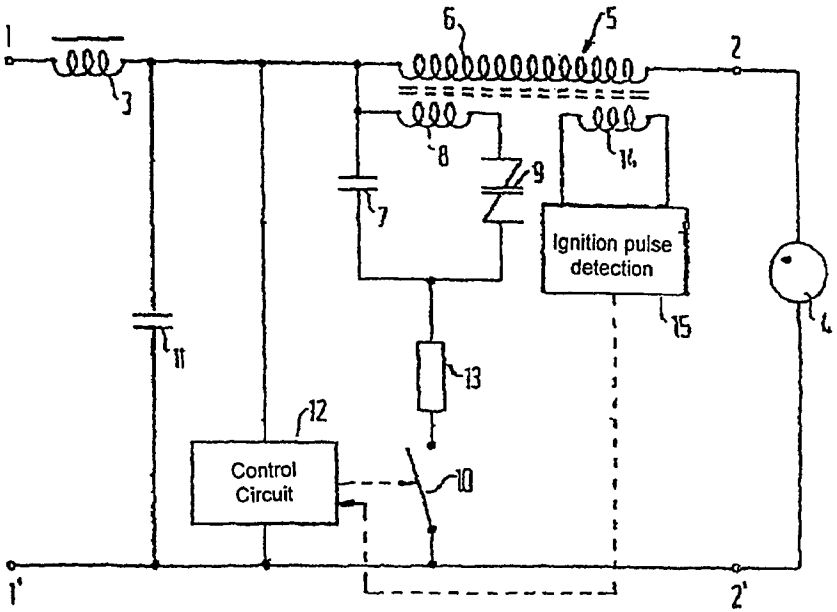
Fig. 6 (Prior Art)

With reference to FIG. 4 it will now be explained how, with a micro-controller or ASIC U1, such a regulation/control process for the ignition pulse amplitude can be carried out.

The switch, in this case an MOSFET transistor M1, is connected in a semiconductor bridge with a diode D1. The desired value for the ignition point amplitude $Uz_{ref}$ is predetermined by means of a corresponding selection of a resistance R6. At a terminal $Uz_{in}$, of the ASIC U1 the ignition pulse voltage at the terminal LA is detected via a measurement resistance R2.

The input $U_{br\text{-}in}$ serves for internal functions of the ASIC.

By means of a (per se known) external bandgap reference, the voltages $V_{dd}$ for the control logic itself and the voltage $V_{ss}$ for an output driver for the control signal OUT for the switch S1, M1 are regulated.

At the input $Uz_{\text{-}in}$ the lamp burning voltage can be detected.

Further, by means of the input $Uz_{in}$, the zero crossing of the mains voltage can be detected. Each zero crossing can trigger a counting process in the control logic, whereby the current count value then represents the momentarily present phase disposition of the mains voltage. This is in particular important for the correct clocking of the switch-on points and thus ignition time points in accordance with the requirements of luminaire manufacturers.

In the control logic, the actual regulation logic is implemented for example by means of a so-called look-up table. That means, in dependence upon the result of the ignition voltage comparison $UZ_{ref}-Uz_{in}$ it is predetermined in the control logic by means of a function or such a table at what time point, or after what switch-on time duration tx, the switch S1, M2 is to be closed and/or again opened, by issue of a corresponding signal OUT,

The invention claimed is:

1. Circuit for the generation of ignition pulses for a lamp, comprising an ignition pulse transformer, a device for the generation of ignition pulses at a primary winding of the ignition pulse transformer, which are transformed in the secondary winding of the ignition pulse transformer to form transformed ignition pulses, means for the detection of a voltage value of the transformed ignition pulses, and a device for the regulation of the voltage value of the transformed ignition pulses to a predetermined reference value, wherein the voltage value of the transformed ignition pulses is continuously set.

2. Circuit according to claim 1, wherein after ignition of a connected lamp has been effected the ignition pulse transformer serves as choke for limiting the lamp current.

3. Ballast for a lamp comprising the circuit of claim 1.

4. Circuit according to claim 1, wherein the device for the generation of ignition pulses has a series circuit of a pulse capacitor and a switch parallel to the secondary winding of the ignition pulse transformer and the lamp, and the device for the regulation of the voltage value of the transformed ignition pulses sets a voltage applied at the pulse capacitor at an ignition time point.

5. Circuit according to claim 4, wherein the voltage at the pulse capacitor is set by selection of switch-on and/or switch-off time points of the switch.

6. Circuit according to claim 1, wherein the device for the regulation of the voltage value of the transformed ignition pulses controls the switch-on duration of the switch.

7. Luminaire, having a ballast in accordance with claim 3.

8. Circuit for the generation of ignition pulses for a lamp, comprising an ignition pulse transformer, an ignition pulse generator generating ignition pulses at a primary winding of the ignition pulse transformer, which are transformed in the secondary winding of the ignition pulse transformer, wherein the ignition pulse generator has a pulse capacitor and a switch in a series circuit parallel to the secondary winding of the ignition pulse transformer and the lamp, and wherein when the switch is open, a charge in the pulse capacitor remains substantially retained and when the switch is closed, the pulse capacitor charges up to a current instantaneous value of a mains voltage, and a control unit is provided to set switch-on/switch-off time points of the switch.

9. Circuit according to claim 8, wherein the control unit controls a switch-on time duration of the switch, whereby the switch-on time point is selected to be synchronous to a predetermined phase disposition of the mains voltage.

10. Circuit according to claim 8, wherein an Ohmic resistance, inductance or both, are connected in series to the switch.

11. Method for the generation of ignition pulses for a lamp, having the following steps:

generation of ignition pulses at a primary winding of the ignition pulse transformer, which are transformed in the secondary winding of the ignition pulse transformer, wherein the ignition pulses are generated by means of a series circuit of a pulse capacitor and a switch parallel to the secondary winding of the ignition pulse transformer and the lamp, and when the switch is opened a charge in the pulse capacitor substantially remains retained and when the switch is closed the pulse capacitor charges up to current instantaneous value of a mains voltage, wherein opening and closing time points of the switch are arbitrarily set.

12. Method according to claim 11, wherein a switch-on duration of the switch is controlled by a switching-on of the switch synchronously with a mains phase.

13. Method according to claim 12, wherein the switch-on time point of the switch is effected synchronously to a predetermined phase disposition of the mains voltage.

14. Method for the generation of ignition pulses for a lamp, having the following steps:

generation of ignition pulses at a primary winding of an ignition pulse transformer, which are transformed in the secondary winding of the ignition pulse transformer to form transformed ignition pulses, detection of a detected voltage value of the transformed ignition pulses, regulation of the voltage value of the transformed ignition pulses to a predetermined reference value responsive to the detected voltage value of the transformed ignition pulses, wherein the voltage value of the transformed ignition pulses is continuously set.

15. Method according to claim 14, wherein the voltage value of the transformed ignition pulses is regulated by means of a temporal control of a charge/discharge processes of a pulse capacitor.

16. Method according to claim 14 comprising the following steps:

closing a charge/discharge switch of the pulse capacitor at a time point before the peak of a mains half-wave and opening and again closing the switch before attainment of the peak of the directly following mains half-wave.

17. Circuit for the generation of ignition pulses for a lamp, having an ignition pulse transformer, a device for the generation of ignition pulses at a primary winding of the ignition pulse transformer, which are transformed in the secondary winding of the ignition pulse transformer to form transformed ignition pulses, and a device for both increasing and reducing a voltage value of the transformed ignition pulses.

18. Circuit according to claim 17, wherein a control circuit which closes a switch at a time point before a peak of a mains half-wave and before attainment of a peak of a directly following mains half-wave opens and again closes the switch.

* * * * *